US006643611B1

(12) United States Patent
Ito et al.

(10) Patent No.: US 6,643,611 B1
(45) Date of Patent: Nov. 4, 2003

(54) SERVICE SYSTEM FOR AIR CONDITIONER AND SERVER SYSTEM FOR MONITORING CENTER

(76) Inventors: Makoto Ito, c/o Shimizu Works, Hitachi Air Conditioning Systems Co., Ltd., 23-2, Kandasudacho 1-chome, Chiyoda-ku, Tokyo 101-0041 (JP); Tadashi Takai, c/o Shimizu Works, Hitachi Air Conditioning Systems Co., Ltd., 23-2, Kandasudacho 1-chome, Chiyoda-ku, Tokyo 101-0041 (JP); Tomotsune Taira, c/o Hitachi Air Conditioning Systems Co., Ltd. 23-2, Kandasudacho 1-chome, Chiyoda-ku, Tokyo 101-0041 (JP); Masanori Takagi, c/o Hitachi Air Conditioning Systems Co., Ltd. 23-2, Kandasudacho 1-chome, Chiyoda-ku, Tokyo 101-0041 (JP); Yukio Ito, c/o Hitachi Air Conditioning Systems Co., Ltd. 23-2, Kandasudacho 1-chome, Chiyoda-ku, Tokyo 101-0041 (JP)

( * ) Notice: Subject to any disclaimer, the term of this patent is extended or adjusted under 35 U.S.C. 154(b) by 159 days.

(21) Appl. No.: 09/714,938

(22) Filed: Nov. 20, 2000

(30) Foreign Application Priority Data

May 11, 2000 (JP) ..... 2000-143396

(51) Int. Cl.[7] ..... G06F 11/30
(52) U.S. Cl. ..... 702/184
(58) Field of Search ..... 702/184, 185, 702/188; 700/276, 204, 300

(56) References Cited

U.S. PATENT DOCUMENTS 6,385,510 B1 * 5/2002 Hoog et al. ..... 700/276
6,442,529 B1 * 8/2002 Krishan et al. ..... 705/14

FOREIGN PATENT DOCUMENTS

| | | |
|---|---|---|
| JP | A-10-132362 | 5/1998 |
| JP | 11134018 | 5/1999 |
| JP | A-11-230602 | 8/1999 |
| JP | 2000129751 | 5/2000 |

* cited by examiner

*Primary Examiner*—Michael Nghiem
(74) *Attorney, Agent, or Firm*—Antonelli, Terry, Stout & Kraus, LLP

(57) ABSTRACT

A service system for air conditioners is provided which offers a total solution to a wide range of fields, from the customer relationship management covering individual users, building owners and administrators and building management companies to the maintenance and management, manufacture, design, and development on the part of the manufacturer. The service system includes the monitoring center 1 which has the customer database 207, the operation information database 206 for storing operation information of the air conditioners 101 for each customer, and the device information database 203 having device information on the air conditioners 101 related with each customer of the customer database 207. When it decides that there is anomaly in the operation information, the monitoring center 1 sends to the cellular phone 406 over the Internet 306 the information representing the content of the anomaly and the customer information and device information associated with the operation information which was judged abnormal.

11 Claims, 7 Drawing Sheets

FIG.7

ALARM WENT OFF

SERVICE STATION REPAIR CORP
PERSON IN CHARGE OF MAINTENANCE
MAINTENANCE MANAGEMENT NO. J0003 REMOTE MANAGEMENT NO
ORDERER: EEE AIR CONDITIONING SYSTEM
DELIVERY SITE: EEE AIR CONDITIONING SYSTEM
LOCATION OF INSTALLATION: FFF REAL ESTATE BUILDING

END

INFORMATION ON DEVICE IN WHICH ANOMALY OCCURRED:
24 PIPING TEMPERATURE THERMISTOR ABNORMAL (OUTDOOR UNIT)
TIME OF OCCURRENCE: 2000/03/10 14:25
HARC NO. 0002 SYSTEM NO. 02

MAIL PAGER FAX

SERVICE SYSTEM FOR AIR CONDITIONER AND SERVER SYSTEM FOR MONITORING CENTER

BACKGROUND OF THE INVENTION

The present invention relates to a service system for maintenance, inspection and monitoring of air conditioners and more suitably to a service system that enables quick or reliable maintenance services in the event of a trouble.

A technology has been known which, to quickly deal with an abnormal control condition of an air conditioner or a request for version-up, stores in the air conditioner the abnormal data representing an abnormal control condition and the version-up information for making improvements on a program and makes these data accessible via a communication system of a wireless communication terminal. Such a technology is disclosed in JP-A-10-132362, for example.

Another technology is known which monitors the operating condition of an air conditioner and puts the monitored information in the HTML (Hyper Text Markup Language) file format on the Internet to enable a diagnostic of a failure to be performed and necessary steps to be taken quickly in the event of a failure. Such a technology is disclosed in JP-A-11-230602.

These conventional technologies are desirable for a serviceman to quickly deal with an abnormal condition of the air conditioner in an individual system or to forestall a possible failure or shutdown. As the system has become sophisticated in recent years, however, in terms of diversity and complexity with a number of units being used even in a single building, there are growing demands for increased speed of information transmission and for information sharing, not only in the field of maintenance and management such as repair services but also in other fields ranging from customer relationship management to design and development in the factory.

SUMMARY OF THE INVENTION

In light of the circumstances described above, an object of the present invention therefore is to provide a service system for air conditioners which offers a total solution to a wide range of fields, from the customer relationship management covering individual users of air conditioners, building owners and administrators and building management companies to the maintenance and management, manufacture, design, and development on the part of the manufacturer.

Another object of the invention is to provide a service system for air conditioners which not only allows maintenance services to be provided more quickly but also enables building owners and administrators and building management companies to cut back on personnel expenditure and running cost for management.

To achieve the above objectives, there is provided a service system for air conditioners that monitors the operating condition of the air conditioners and performs their maintenance, the service system comprising: a monitoring center having a customer database having customer information, an operation information database for storing operation information of the air conditioners for each customer, and a device information database having device information on the air conditioners and related with each of the customers stored in the customer database; wherein the monitoring center checks the operation information for any anomaly of the air conditioners and, when it decides that an abnormal condition has occurred, transmits information representing a content of the anomaly and the customer information and device information associated with the operation information that was judged to be abnormal, over the Internet to a cellular phone capable of displaying character information.

In the above service system, the information representing the content of the anomaly and displayed on a screen of the cellular phone is preferably a failure code, a failure name, and information on an electric system in a building where a failed air conditioner is installed.

In the above service system, the cellular phone preferably displays the information by successively switching the screens.

According to another aspect of the invention, there is provided a service system for air conditioners which, in the event of a trouble, restores them to normal, the service system comprising: a monitoring center for checking operation information of the air conditioners for any anomaly or sign of anomaly and posting information related with the anomaly on an Internet home page; and a cellular phone made usable as an input terminal to access the home page; wherein reply information concerning the anomaly or sign of anomaly can be entered from the cellular phone.

In the above service system, the reply information preferably includes a link that can access, with a single action, a response home page provided by the monitoring center.

In the above service system, it is preferred that whether a serviceman has arrived at a site be able to be entered as the reply information.

According to another aspect of the invention, there is provided a service system for air conditioners which, when it is decided that there is an anomaly or sign of anomaly with the air conditioners, restores them to normal, the service system comprising: a monitoring center having a device information database having device information on the air conditioners, a failure code database for storing, for each failure code, information representing a content of anomaly and its possible cause, and a parts information database having maintenance parts information related with the devices in the device information database and with the failure codes, the monitoring center being adapted to check for any anomaly or sign of anomaly of the air conditioners and post the failure code on an Internet home page; and a terminal device capable of accessing the monitoring center over the Internet; wherein an order of maintenance parts associated with the failure code can be made from the terminal device.

In the above service system, it is preferred that information representing prices, stocks and delivery times of maintenance parts be provided from the monitoring center to the terminal device when the maintenance parts are ordered.

In the above service system, it is preferred that an invoice be able to be generated in response to the ordering of maintenance parts and distributed from the monitoring center to the customer.

According to still another aspect of the invention, there is provided a service system for air conditioners which remotely monitors the operating condition of the air conditioners for maintenance and inspection, the service system comprising: a monitoring center having a device information database having device information on each type of air conditioner, a failure code database for storing, for each failure code, information representing a content of anomaly and its possible cause, and a parts information database having maintenance parts information related with the devices in the device information database and with the failure codes, the monitoring center being adapted to check for any anomaly or sign of anomaly of the air conditioners and post the failure code on an Internet home page; and a terminal device capable of accessing the monitoring center over the Internet and entering reply information concerning the anomaly or sign of anomaly; wherein the monitoring center takes statistics of failure history for each type of air conditioner stored in the device information database and posts the statistics on the home page so that they can be browsed.

According to a further aspect of the invention, there is provided a monitoring center server for monitoring and maintaining air conditioners, comprising: monitoring software for receiving operation information of the air conditioners and checking the operation information for any anomaly or sign of anomaly of the air conditioners; an operation information database for storing the operation information by relating it to customers; and A customer database or a device information database having customer information and device information related to the customers; wherein, when an anomaly or sign of anomaly is detected from the operation information, the monitoring center server transmits information representing a content of the anomaly or sign of anomaly and the customer information and device information associated with the operation information in which the anomaly or sign of anomaly was detected.

BRIEF DESCRIPTION OF THE DRAWINGS

FIG. 7 is a screen showing a home page for response in the one embodiment of the invention.

DETAILED DESCRIPTION OF THE EMBODIMENTS

One embodiment of the present invention will be described by referring to FIGS. 1 through 7.

Designated 101 are air conditioners which normally comprise a plurality of indoor units and outdoor units combined and used in many applications such as offices, commercial facilities, hotels and houses. In large-scale city plannings centering on office buildings in recent years, the air conditioning facilities have increased in scale and their operating schemes and time zones have become complicated, which in turn necessitates detailed operation, management and maintenance of the facilities.

The air conditioners 101 installed at one location for one customer are arranged in a plurality of combined sets, each consisting of 16 outdoor units and 128 indoor units for example. As many as 128 outdoor units and 1024 indoor units are often installed at one location in a networked configuration. Conventionally, package air conditioners have often been networked uniquely, but in recent years they have come to be networked in an open configuration at equipment level.

Figure 1:
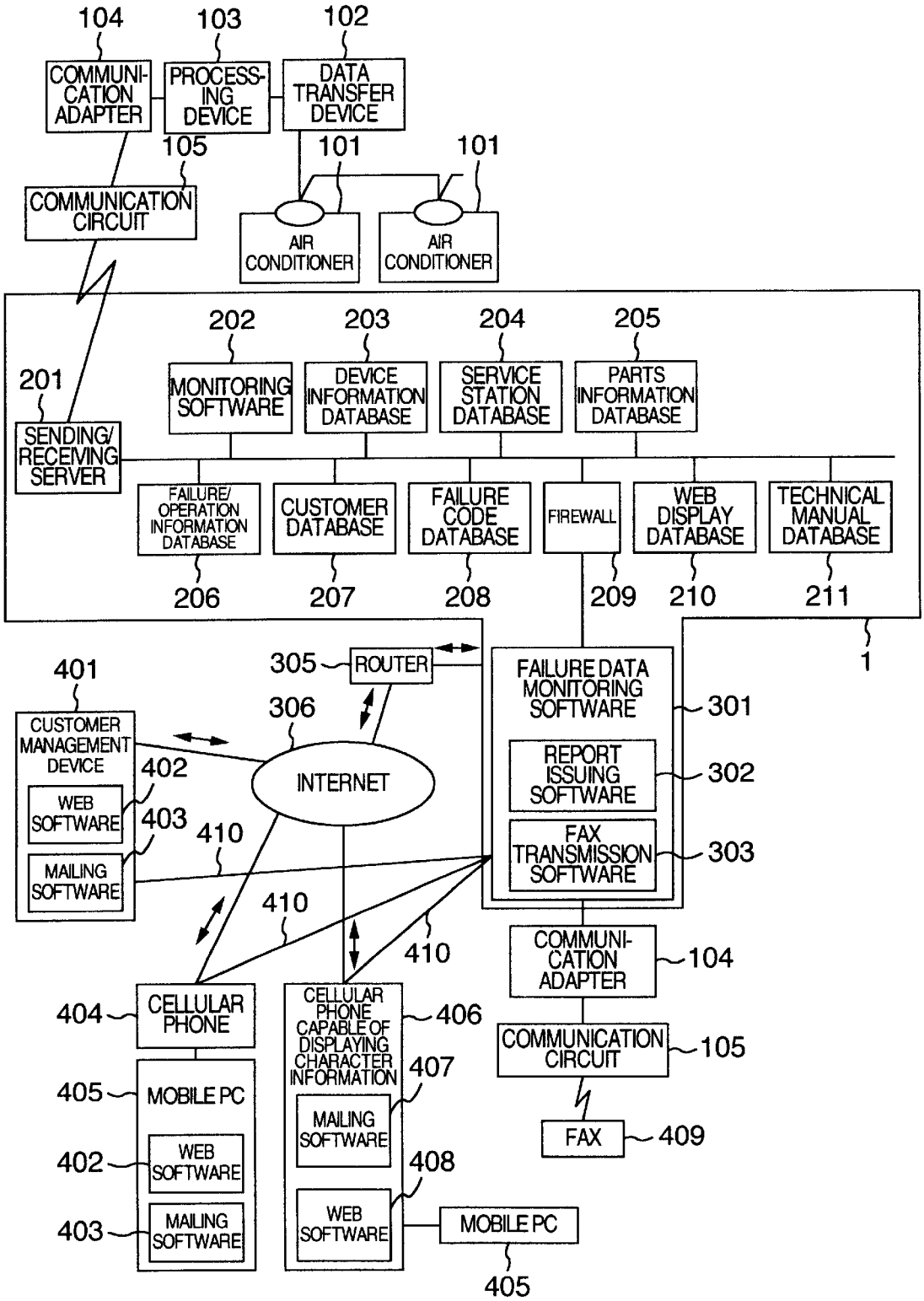
FIG. 1 is a block diagram showing an overall system of one embodiment of the invention.

In FIG. 1, the air conditioners 101 are connected to a data transfer device 102, to which the air conditioners 101 periodically or non-periodically transmits, as their operation information, temperatures of air conditioners' main components in a refrigeration cycle (such as set temperature, suction air temperature, delivered air temperature of each indoor unit), pressure, compressor current and frequency.

The data transfer device 102 holds data from the air conditioners 101 and sends to the air conditioners 101 control signals for on/off operation, temperature setting, air flow control, and operation schedule and management. Further, the data transfer device 102 is connected to a processing device 103 which performs a bidirectional communication with the data transfer device 102 to monitor and control the operating condition of the air conditioners 101. The processing device 103 performs a two-way communication with a sending/receiving server 201 through an adapter 104 and a communication circuit 105. The monitoring and control of the operating condition of the air conditioners 101 can be executed by the sending/receiving server 201. The adapter 104 may be enhanced in its function and integrated with the processing device 103 and the data transfer device 102.

A monitoring center 1, the monitoring device for the air conditioners 101, has, in addition to the sending/receiving server 201, monitoring software 202 for monitoring data from the sending/receiving server 201 and therefore the operating condition of the air conditioners 101; a device information database 203 having information on various types of air conditioners, such as specifications and appropriate installation conditions for each type of air conditioners 101; a service station database 204 having information on service stations assigned to perform maintenance on the air conditioners; and a parts information database 205 containing order numbers of maintenance parts for each air conditioner, information on their stocks and delivery times, and image information such as pictures of the parts. These data should preferably be stored in the HTML (hypertext markup language) or XML (extensible markup language) format.

The monitoring center 1 also includes: a failure/operation information database 206 for storing a failure history of the air conditioners 101, operation data at times of failure and operation information during steady state operation; a customer database 207 for storing information on customers of the air conditioners 101; a failure code database 208 for storing contents of failure codes of air conditioners, possible causes of failure, methods of identifying causes and restoration methods; a Web display database 210 for generating display information in hypertext and storing it as data for the WWW browser; a technical manual database 211 for storing precautions for installing air conditioners, a method for test operation, precautions for handling, and manual for usage; a firewall 209 for protecting the customer database 207 and so on against unauthorized access from outside; and failure data monitoring software 301 for, in the event of a failure, collecting the operation information, device information and customer information and so on from the failure/operation information database 206, device information database 203 and customer database 207 and so on and managing these data as failure data.

The failure data monitoring software 301 is connected to the Internet 306 through a router 305 and has report issuing software 302 and FAX transmission software 303. The report issuing software 302 issues anomalies, alarms showing signs of anomalies and retry information showing signs of alarms and so on in the form of e-mails to the outside, and the FAX transmission software 303 sends facsimiles directly to terminals.

The operation information representing the operating condition of air conditioners is stored for each customer of the customer database 207. The device information database 203 stores device information for each type of air conditioner which is related to each customer of the customer database 207. From these information, it is possible to determine at least the types of air conditioners used by each customer. Hence, identifying the customer can retrieve details of the types used by that customer.

The cellular phone 406 can display information equivalent to at least several hundred characters and should preferably be compatible with the i-mode (registered trademark of NTT DoCoMo, Inc.) or J-phone (registered trademark of Tokyo Digital Phone, Inc.). The cellular phone 406 incorporates mailing software 407 that can browse and generate Internet mails and Web software 408 that can show display information generated in hypertext. The cellular phone 406 can be connected with a mobile small personal computer 405 or the like to browse information offered by the failure data monitoring software 301. A cellular phone 404 is connected with a mobile PC 405 to connect the Web software 402 and mailing software 403 incorporated in the mobile PC 405 to the Internet 306 to browse the information offered by the failure data monitoring software 301.

A customer management device 401 can connect to the Internet 306 and browse the information provided by the failure data monitoring software 301 using the Web software 402 and mailing software 403.

Next, the operation of this embodiment will be explained.

When a failure, an anomaly, or a symptom of anomaly occurs in the air conditioner 101, the operation information of the air conditioner 101 is transmitted to the sending/receiving server 201 where it is held.

The monitoring software 202, which is monitoring the operation information, decides from the operation information received that there is an anomaly and notifies the data (information representing the content of anomaly, the date of occurrence of the anomaly, or information on retries and the number of retries and so on) to the failure data monitoring software 301.

Regarding the air conditioner 101 in which an anomaly or a symptom of anomaly occurred, the failure data monitoring software 301 collects, simultaneously or as required, operation information at time of failure and operation information during normal operation from the failure/operation information database 206; device-specific data, such as device specifications and installation conditions, from the device information database 203; a telephone number of a service station for maintenance and a name of a person to contact from the service station database 204; a table of maintenance parts and their stocks from the parts information database 205; a customer name and a telephone number from the customer database 207; a method of identifying a failure cause, possible causes of the failure and a restoration method from the failure code database 208; display information generated in hypertext compatible with the WWW browser from the Web display database 210; and precautions for test operation and installation and information on handling from the technical manual database 211.

The device information database 203 is related with each of the customers in the customer database 207 and stores information on each type of air conditioner. Thus, the failure data monitoring software 301, according to the contract with each customer in the customer database 207, sends to the cellular phone 406 capable of displaying characters an e-mail carrying the information representing the content of anomaly and the customer and device information associated with the operation information that was judged to be abnormal, in the form of an alarm mail (information representing the content of the anomaly, such as date of occurrence of the anomaly) or a retry mail (information on retries, such as the number of retries made). One or more destinations of the e-mail are registered in the monitoring center 1 for each customer. The contract may include, for example, a contract-a which simply sends an e-mail only when an alarm occurs with the air conditioner, a contract-b which involves monitoring the operating condition at all times and analyzing the operation information to inform the customer of any sign of abnormal condition and perform maintenance accordingly to prevent a possible failure, and a contract-c which further involves setting temperature and air flow, or even performing an operation schedule management. These contracts have different charges.

Because the cellular phone 406 can be carried easily by a serviceman at all times, he or she can immediately know when there is an anomaly or sign of anomaly in the air conditioner. The customer information and device information are also transmitted, allowing the serviceman to quickly take a necessary action for the customer.

If the information representing an anomaly to be shown on the display of the cellular phone 406 includes a failure code, a failure name and information on an electric system in the building in which the air conditioner in question is installed, the service personnel can not only take an appropriate action when informed of the anomaly or sign of anomaly but perform quick and appropriate steps in the initial phase, such as investigation at the site where the air conditioner 101 is installed.

Further, if the cellular phone 406 is made to display information by switching screens successively, increased amount of information can easily be understood by the viewer.

The failure data monitoring software 301 makes available as the content of data to be transmitted a cause of failure, a location of installation and a telephone number for contact to ensure that the normal operation of the air conditioner can be restored reliably and quickly. At the same time, the serviceman can enter into the cellular phone 406 what was done to the anomaly or sign of anomaly. Based on the data the serviceman has entered, the failure data monitoring software 301 sends a progress report on the maintenance work to the customer management device 401. For that purpose, the monitoring center 1 may, for example, post the anomaly information on the Internet home page, with the cellular phone 406 used as an input terminal to access the home page. If the screen on the cellular phone 406 includes a link that, with a single action, allows access to the response home page provided by the monitoring center 1, the detailed progress of the maintenance work can be reported to the monitoring center 1. If the reply information to be entered by the serviceman and transmitted to the monitoring center 1 includes at least whether the serviceman has arrived at the site, it is possible on the side of the monitoring center 1 to confirm the current situation of the maintenance service and perform a separate investigation into the cause of trouble to support the serviceman working at the site.

The failure data monitoring software 301 in the monitoring center 1 sends data to the character information display cellular phone 406 over the Internet 306 or directly over the telephone line 410 so that the serviceman after arriving at the site can check the method of identifying the cause of trouble, search the part numbers of maintenance parts, confirm their stocks and order necessary parts. That is, by accessing the monitoring center 1 over the Internet, the maintenance parts associated with the failure code can be ordered from a terminal device, such as cellular phone 406 and mobile PC 405. This enables quick actions to be taken in repairing the air conditioner 101 and also reduces personnel expenses in the process of parts ordering. If, in ordering the maintenance parts, the monitoring center 1 provides information indicating the price, stock and delivery time of the maintenance parts to the terminal device, the serviceman at the site can make an appropriate selection of parts. Further, because an invoice is generated in connection with the maintenance parts ordering process and then delivered from the monitoring center 1 to the customer, the parts ordering process can be implemented more swiftly and reliably.

Next, an example of display and operation on the cellular phone 406 will be explained in detail by referring to FIGS. 2 through 7.

FIGS. 2 to 6 show screens of the cellular phone 406. These screens may be displayed either continuously or as separate screens, but the information should preferably be displayed by switching the screens successively. It is also preferred that an easy access to a certain part of the screen be prevented as by a password and so on. Further, considering the number of characters in one section that can be transmitted or displayed at one time, the character information on each screen should preferably use abbreviated names and predetermined symbols or signs to reduce the amount of information, enhancing the ease with which the information can be read and reducing the cost.

Figure 2:
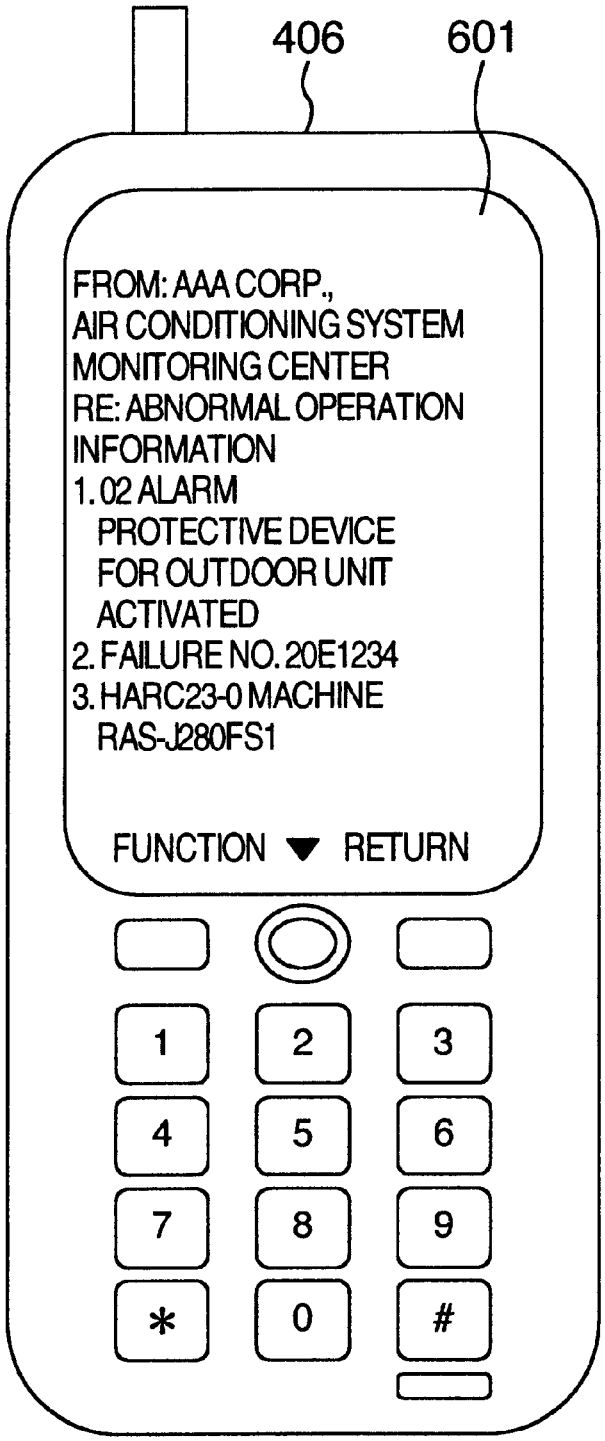
FIG. 2 is a front view of a cellular phone in the one embodiment of the invention showing an initial screen.
Figure 3:
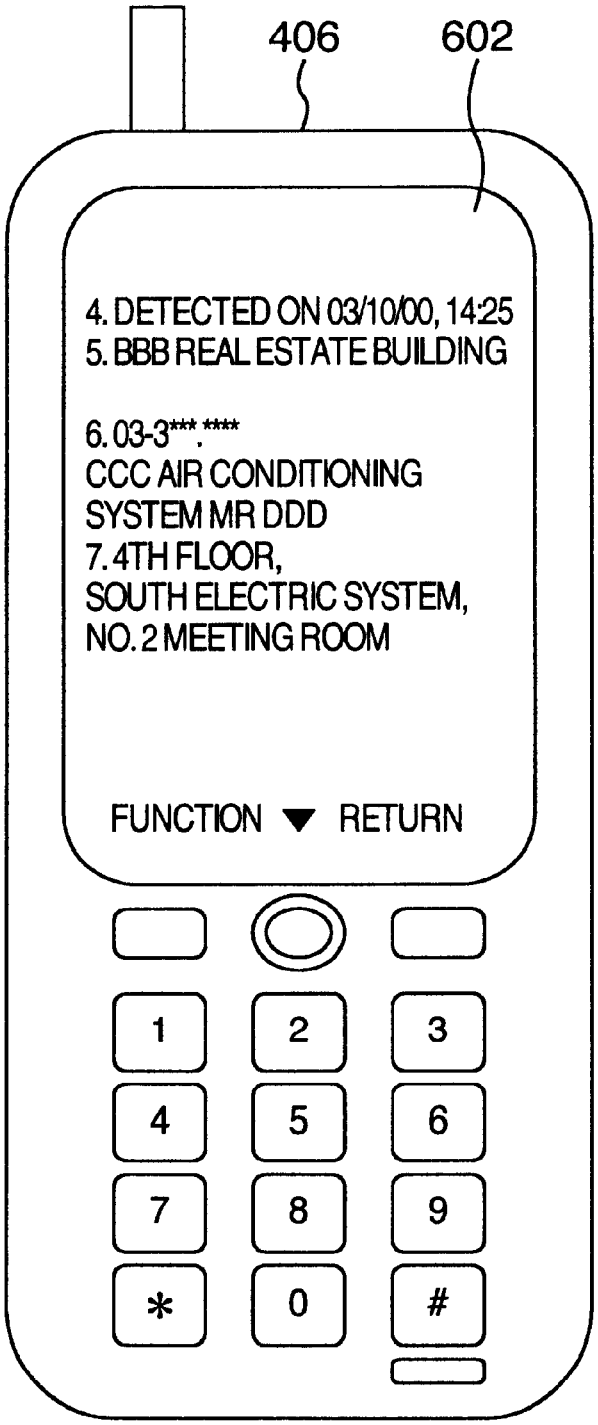
FIG. 3 is a front view of the cellular phone showing the next screen following FIG. 2.

An initial information screen 601 of FIG. 2 is used to inform the serviceman of initial information on the failure. This screen displays a failure code and failure name indicating the content of the failure, a management number such as data assigned individually to the failure, and information on an electric system in a building where the failed air conditioner is installed. FIG. 3 shows a date of failure, a name of building where the air conditioner in question is installed, a customer name and telephone number, and a room number where the failed air conditioner is located. From these information, the serviceman can know the urgency of the trouble, contact the customer and, based on his experience, estimate the time required for the maintenance work and necessary materials and equipment. For an inexperienced serviceman, it is desired that information suggesting a service procedure be displayed in behalf of an experienced serviceman.

Figure 4:
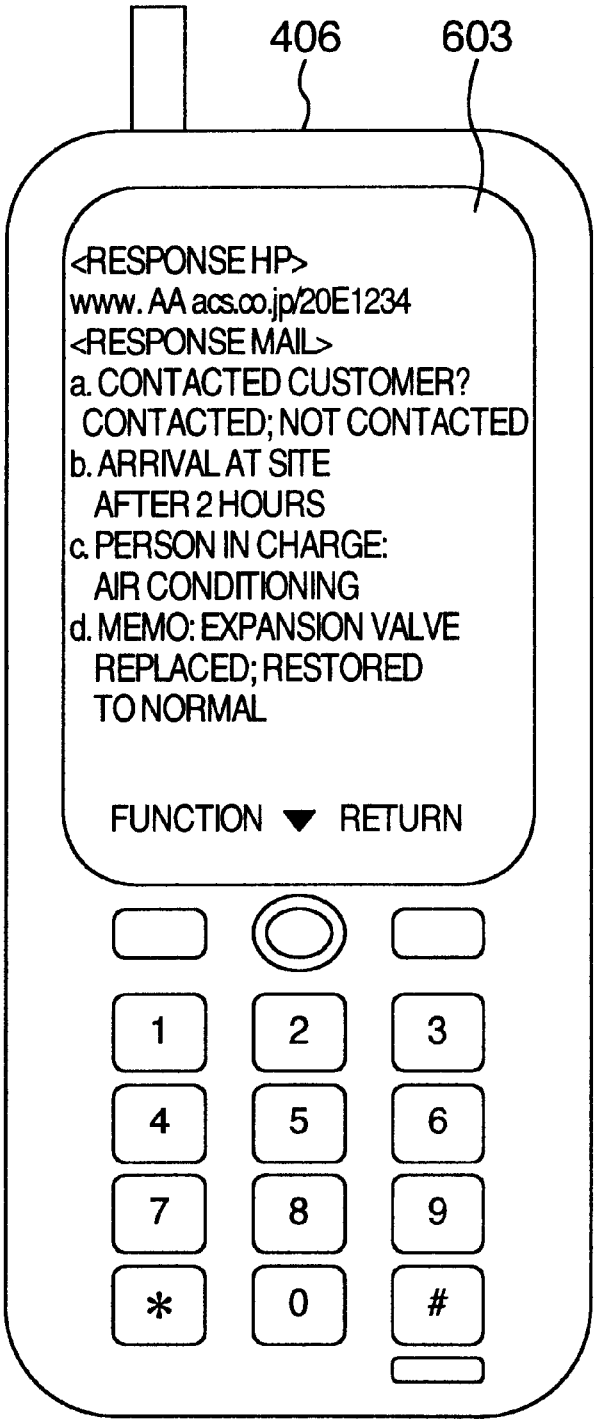
FIG. 4 is a front view of the cellular phone in the one embodiment of the invention showing a response screen.
Figure 5:
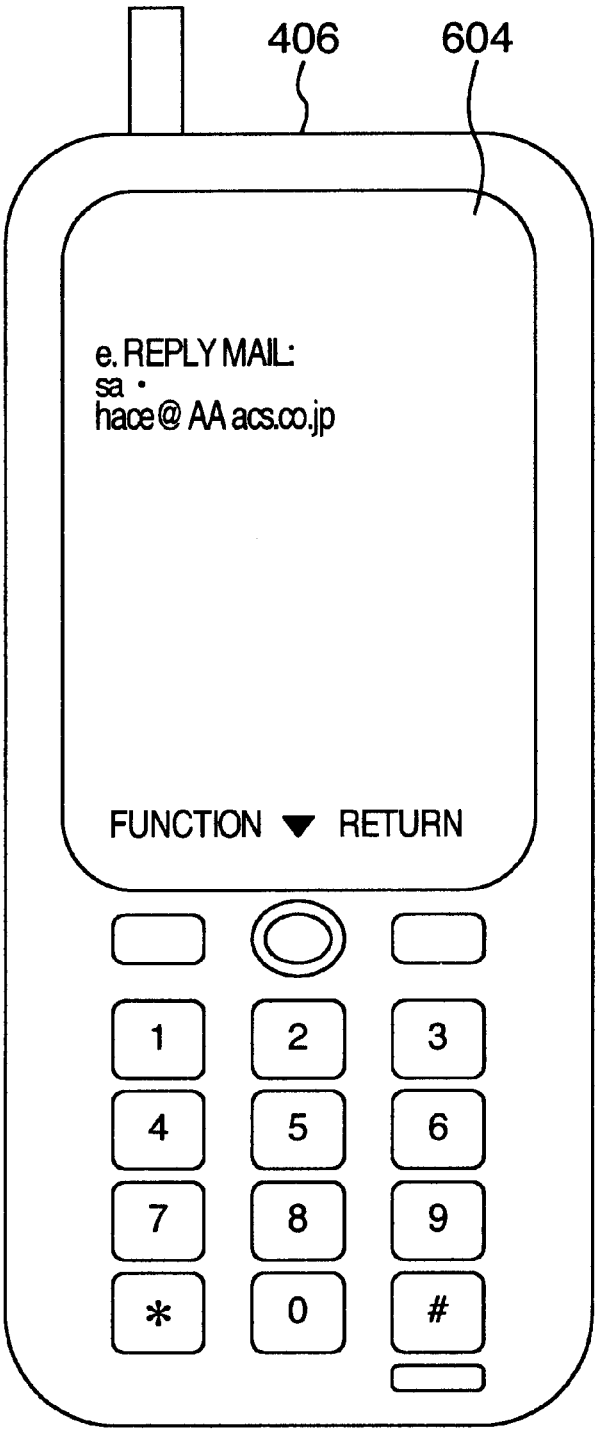
FIG. 5 is a front view of the cellular phone showing the next screen following FIG. 4.

FIGS. 4 and 5 show a link button as a URL (uniform resource locator) on the screen which is prepared for each failure and used to access the response home page. This link allows, with a single-action, access to the response home page provided by the monitoring center 1 that works as a server.

The response home page is configured as shown in FIG. 7 for example. It displays various information and also allows a serviceman to click on command buttons on the screen, such as "end" and "mail", to enter what was done.

Figure 6:
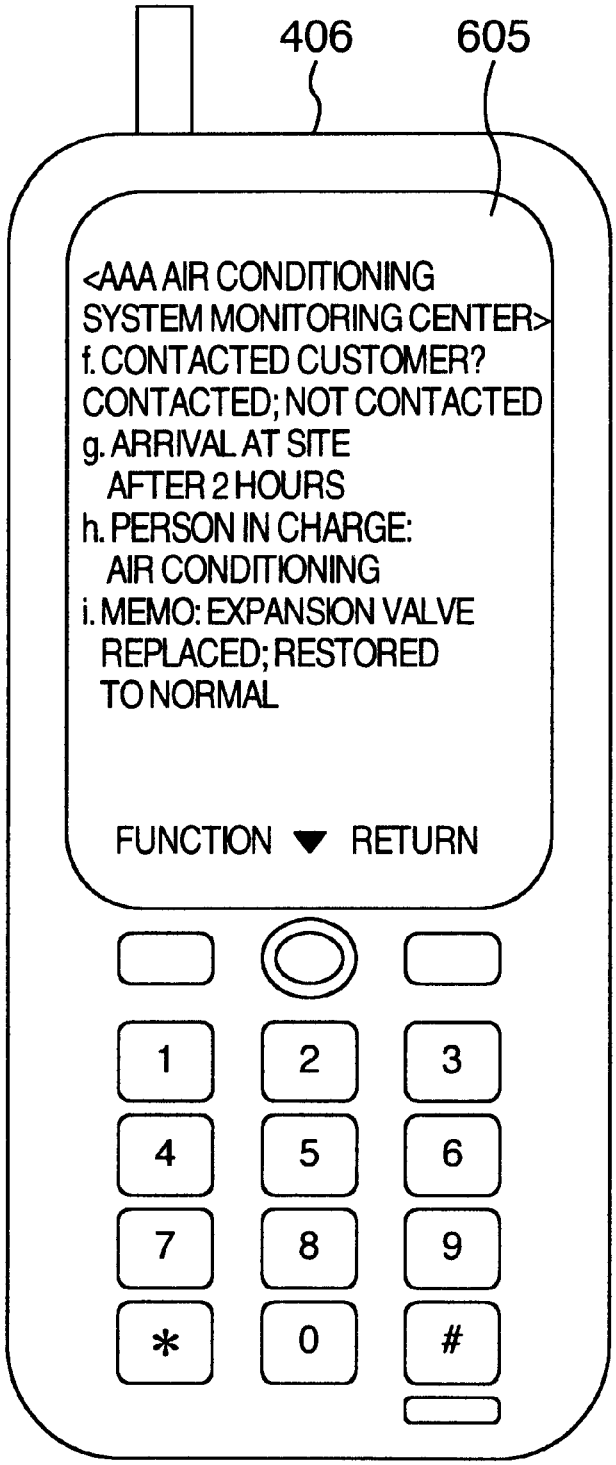
FIG. 6 is a front view of the cellular phone showing the next screen following FIG. 5.

Items "a", "b", "c" and "d" on the screen show an example form of the reply mail. The reply mail should preferably be configured so that one can select and delete unwanted words to form a sentence and also enter desired character information at least in some part. For example, this reply mail should desirably include a memo in which one can enter arbitrary information, such as whether the serviceman has arrived at the site, the time spent to reach the site, the name of the serviceman, a schedule of the work at the site and a result of the work done. Further, a return mail address, the destination of this mail, is displayed as shown in FIG. 5. Using this mail, the serviceman can report the situation at the site even while he is moving or when the telephone lines of the monitoring center 1 are busy. Then, the monitoring center 1 can check what the serviceman has done at the site, and quickly provide the customer with appropriate information and issue necessary directions to the serviceman. FIG. 6 shows a second page following the reply mail screen of FIG. 5. On this page the serviceman can enter such information as whether he has contacted the customer, how long it has been after his arrival, and whether the air conditioner has returned to normal.

The failure code database 208 stores information representing the content of anomaly for each failure code and its possible cause. The parts information database 205 has the maintenance parts information related with device and failure codes contained in the device information database 203. It is therefore desirable to separately prepare in the terminal device, such as cellular phone 406, a screen for checking the price, stock and delivery time of replacement parts, a screen for ordering replacement parts, a screen for searching replacement parts, and a screen for displaying pictures of replacement parts, failure history and operation data before the fault. The monitoring center 1 is provided with a service function which generates, simultaneously with the ordering of the replacement parts, a quotation or invoice of the ordered parts in the form of an Internet home page, Internet mail or document and distributes it to the customer. Further, it is preferred that the monitoring center 1 take statistics of failure history for each air conditioner type contained in the device information database 203 and make the statistics available on the home page. When these data are made available in the XML format, they can be shared among different applications that produce a quotation or invoice, send a mail to a customer, take statistics and generate a graph.

As described above, this invention allows the processing to be executed automatically even when a person in charge is in a train or a meeting where the use of a cellular phone should be restrained, which is not possible with the conventional techniques. Because the processing is done using character information, misunderstanding can be eliminated and reliability improved. Further, the customer service can also be improved according to the contract, as by displaying only a part of the screen described earlier on a cellular phone 406 carried by a customer's staff who is in charge of the facility.

Further, because the monitoring center 1 monitors the operating condition of the air conditioners 101 to manage the maintenance and inspection, nationwide statistics can be taken automatically, allowing a scheduled improvement of service quality.

Furthermore, a system connected with a mobile personal computer 405 rather than the cellular phone 406 and with a cellular phone 404 may be used, or a personal computer 401 of the customer management device used. A character information service provided by cable TVs and wireless TVs may be advantageously used as a display means to increase the communication speed.

It is therefore possible to provide a service system for air conditioners which enables a faster transmission of, and a sharing of, information used to quickly deal with anomalies of air conditioners or forestall a possible failure or shutdown, in a wide range of fields from the customer relationship management covering individual users of air conditioners, building owners and administrators and building management companies to the maintenance and management, manufacture, design, and development on the part of the manufacturer.

what is claimed is:

1. A service system for air conditioners that monitors the operating condition of the air conditioners and performs their maintenance, the service system comprising:

a monitoring center having a customer database having customer information, an operation information database for storing operation information of the air conditioners for each customer, and a device information database having device information on the air conditioners and related with each of the customers stored in the customer database, wherein the monitoring center checks the operation information for any anomaly of the air conditioners and, when it decides that an abnormal condition has occurred, transmits information representing a content of the anomaly, customer information and device information associated with the operation information that was judged to be abnormal, over the Internet to a cellular phone capable of displaying character information based on ranked contract contents for a customer corresponding to the transmitted customer information.

2. A service system for air conditioners according to claim 1, wherein the information representing the content of the anomaly and displayed on a screen of the cellular phone is a failure code, a failure name, and information on an electric system in a building where a failed air conditioner is installed.

3. A service system for air conditioners according to claim 1, wherein the cellular phone displays information by successively switching the screens.

4. A service system for air conditioners according to claim 1, wherein said contract contents comprise:

at least one of a contract of informing an alarm in an air conditioner, a contract of monitoring an operation to inform a sign of anomaly to prevent a failure, and a contract of scheduling control of temperature and air flow.

5. A service system for air conditioners according to claim 1, wherein reply information regarding what was done with respect to the anomaly is sent from said cellular phone.

6. A service system for air conditioners according to claim 1, wherein said information transmitted from said monitoring center includes a link to access with a single action to a response home page provided by said monitoring center.

7. A service system for air conditioners which, when it is decided that there is an anomaly or sign of anomaly with the air conditioners, restores them to normal, the service system comprising:

a monitoring center having a device information database having device information on the air conditioners, a failure code database for storing, for each failure code, information representing a content of anomaly and its possible cause, and a parts information database having maintenance parts information related with the devices in the device information database and with the failure codes, the monitoring center being adapted to check for any anomaly or sign of anomaly of the air conditioners and post the failure code, a failure name, and information on a system of a failed air conditioner on an Internet home page; and a terminal device capable of accessing the monitoring center over the Internet;

wherein identification of cause of trouble, search of maintenance parts, confirmation of stocks and an order of maintenance parts associated with the failure code can be made from the terminal device.

8. A service system for air conditioners according to claim 7, wherein information representing prices, stocks and delivery times of maintenance parts is provided from the monitoring center to the terminal device when the maintenance parts are ordered.

9. A service system for air conditioners according to claim 7, wherein an invoice can be generated in response to the ordering of maintenance parts and distributed from the monitoring center to the customer.

10. A server system for air conditioners which remotely monitors the operating condition of the air conditioners for maintenance and inspection, the service system comprising:

a customer information database having customer information;

an operation information database having operation information for each customer, and a device information database having device information on each type of air conditioner of each customer in said customer information database, wherein when an anomaly of an air conditioner is detected based on the operation information, information representing a content of the anomaly, customer information and device information associated with the operation information that was judged to be abnormal, is transmitted over an Internet to a cellular phone capable of displaying character information based on ranked contract contents for a customer corresponding to the transmitted customer information.

11. A monitoring center server according to claim 10, wherein said contract contents comprise:

at least one of a content of informing an alarm in an air conditioner;

a contract of monitoring an operation to inform a sign of anomaly to prevent a failure; and a content of scheduling control of temperature and airflow.

* * * * *